US006970659B2

(12) United States Patent
Serizawa

(10) Patent No.: US 6,970,659 B2
(45) Date of Patent: Nov. 29, 2005

(54) IMAGE FORMING APPARATUS EQUIPPED WITH DETACHABLE PROCESS CARTRIDGE AND CONTROL METHOD THEREFOR

(75) Inventor: Yoji Serizawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 09/927,540

(22) Filed: Aug. 13, 2001

(65) Prior Publication Data

US 2002/0021914 A1 Feb. 21, 2002

(30) Foreign Application Priority Data

Aug. 16, 2000 (JP) ..... 2000-247000

(51) Int. Cl.[7] ..... G03G 15/00
(52) U.S. Cl. ..... 399/43; 399/25
(58) Field of Search ..... 399/12, 38, 25, 399/43, 46, 75, 111

(56) References Cited

U.S. PATENT DOCUMENTS 4,961,088 A 10/1990 Gilliland et al. ..... 355/206
5,926,665 A * 7/1999 Suzuki ..... 399/25
5,950,036 A * 9/1999 Konishi ..... 399/43 X
5,956,541 A * 9/1999 Hoshika et al. ..... 399/25 X
6,188,852 B1 2/2001 Ojima et al. ..... 399/25
6,205,298 B1 * 3/2001 Yamamoto ..... 399/25
6,212,338 B1 * 4/2001 Hagihara et al. ..... 399/12
6,597,876 B1 7/2003 Sakurai et al. ..... 399/25

FOREIGN PATENT DOCUMENTS

JP 08-160680 * 6/1996
JP 09-120198 * 5/1997
JP 11-202572 7/1999

* cited by examiner

*Primary Examiner*—Sandra L. Brase
(74) *Attorney, Agent, or Firm*—Fitzpatrick, Cella, Harper & Scinto

(57) ABSTRACT

An image forming apparatus is equipped with a process cartridge detachable therefrom, where the process cartridge includes an element relating to image formation. A drive time of the process cartridge driven in the image forming apparatus is counted and it is judged whether an accumulation of the drive time counted reaches a predetermined value. When it is judged that the accumulation of the drive time reaches a predetermined value, an image forming condition of the image forming apparatus is changed over at a timing when the image forming apparatus does not conduct image formation.

8 Claims, 9 Drawing Sheets

FIG. 6

| BIT | CONTENTS |
|---|---|
| 1st Bit | 0 |
| 2nd Bit | 0 JOB INFORMATION DESIGNATING CODE |
| 3rd Bit | 0 |
| 4th Bit | 1 |
| 5th Bit | NUMBER OF SHEET OF JOB DESIGNATING CODE $2^{10}$ |
| 6th Bit | NUMBER OF SHEET OF JOB DESIGNATING CODE $2^{9}$ |
| 7th Bit | NUMBER OF SHEET OF JOB DESIGNATING CODE $2^{8}$ |
| 8th Bit | NUMBER OF SHEET OF JOB DESIGNATING CODE $2^{7}$ |
| 9th Bit | NUMBER OF SHEET OF JOB DESIGNATING CODE $2^{6}$ |
| 10th Bit | NUMBER OF SHEET OF JOB DESIGNATING CODE $2^{5}$ |
| 11th Bit | NUMBER OF SHEET OF JOB DESIGNATING CODE $2^{4}$ |
| 12th Bit | NUMBER OF SHEET OF JOB DESIGNATING CODE $2^{3}$ |
| 13th Bit | NUMBER OF SHEET OF JOB DESIGNATING CODE $2^{2}$ |
| 14th Bit | NUMBER OF SHEET OF JOB DESIGNATING CODE $2^{1}$ |
| 15th Bit | NUMBER OF SHEET OF JOB DESIGNATING CODE $2^{0}$ |
| 16th Bit | ODD PARITY |

IMAGE FORMING APPARATUS EQUIPPED WITH DETACHABLE PROCESS CARTRIDGE AND CONTROL METHOD THEREFOR

BACKGROUND OF THE INVENTION

1. Field of the Invention

The present invention relates to control of an electrophotographic printer having a non-volatile memory inside the printer or in a functional portion capable of transmitting and receiving data to and from the main body of the printer and detachably attachable to the main body.

2. Related Art

FIG. 9 is a block diagram showing a configuration of a conventional printer control portion.

Numeral 101 designates a printer controller, which executes communication with a host computer, which receives image data to expand the received image data into information for the printer to be able to print, and which executes exchange and serial communication of signals with a printer engine control portion described hereinafter. Numeral 102 is an engine control portion, which executes control of each unit in a printer engine through the exchange and serial communication of signals with the printer controller.

Numeral 103 denotes a sheet convey control portion which feeds and conveys a sheet to be printed and which executes sheet conveyance up to discharging of a sheet after being printed, based on an instruction from the engine control portion; numeral 104 an optical system control portion which executes control to drive a scanner motor and ON/OFF of a laser, based on an instruction from the engine control portion; numeral 105 a high voltage control portion which executes output of high voltages necessary for the electrophotographic process including charging, developing, transferring, and so on, based on an instruction from the engine control portion; numeral 106 a fixing temperature control portion which performs control of temperature of a fixing device, based on an instruction from the engine control portion, and which performs detection of abnormality of the fixing device, and the like; numeral 107 a sheet presence/absence sensor input portion which transmits information of sheet presence/absence sensors in a sheet feed portion and in a sheet conveyance path to the engine control portion; numeral 108 a jam detecting portion which detects defective conveyance during sheet conveyance; numeral 109 a breakdown detecting portion which detects a breakdown of a functional part in the printer; and numeral 110 a toner cartridge detachably attachable to the printer engine.

A non-volatile memory 111 capable of transmitting and receiving data to and from the engine control portion is mounted in this toner cartridge, thereby constituting a configuration enabling reading of data from the engine control portion or writing of data therein.

Conventionally, the engine control portion was configured to count up in the non-volatile memory, data concerning consumption of consumable supplies in the process cartridge, e.g., data about operation of the drum (time of rotation of the drum or the like), the residual amount of toner, etc., and to perform, upon arrival at a predetermined threshold, such control as to inform the printer controller of the fact.

The conventional apparatus was, however, designed without sufficient consideration to timing of carrying out a switch process of primary current values for lengthening the lifetime of the process cartridge and thus had the problem that switching occurred during execution of the electrophotographic process, so as to fail to maintain the uniformity of image quality.

SUMMARY OF THE INVENTION

The present invention has been accomplished in view of the above-stated problem and an object of the invention is to provide an image processing apparatus that can maintain the uniformity of image quality in printing of identical images and that can drastically improve the performance of the printer.

The other object of the present invention is to provide an image forming apparatus including an image control portion for expanding predetermined information supplied from an external device, into print information, and a printer control portion for performing print control based on the print information, the image forming apparatus being adapted to print the expanded information in a predetermined recording medium under the print control, the image forming apparatus comprising:

process cartridge means which transmits and receives signals for the print control to and from the printer control portion, which executes an electrophotographic process according to the signals for the print control, and which is detachably attachable to a main body of the image forming apparatus;

non-volatile memory means which stores operation information including information concerning an operation quantity of the process cartridge means and which is mounted in the process cartridge means;

means which performs read/write control of the operation information out of or into the non-volatile memory means, according to the print control from the printer control portion;

switch timing determining means which determines switch timing of a condition for the electrophotographic process, based on the operation information stored in the non-volatile memory means and a state of the printer control portion; and switching means which switches the condition for the electrophotographic process at the switch timing.

The other objects, configurations, and effects of the present invention will become apparent from the detailed description and drawings which follow.

BRIEF DESCRIPTION OF THE DRAWINGS

FIG. 6 is a drawing showing job information to be designated for the engine control portion according to the second embodiment of the present invention;

DETAILED DESCRIPTION OF THE PREFERRED EMBODIMENTS

First Embodiment

Figure 1:
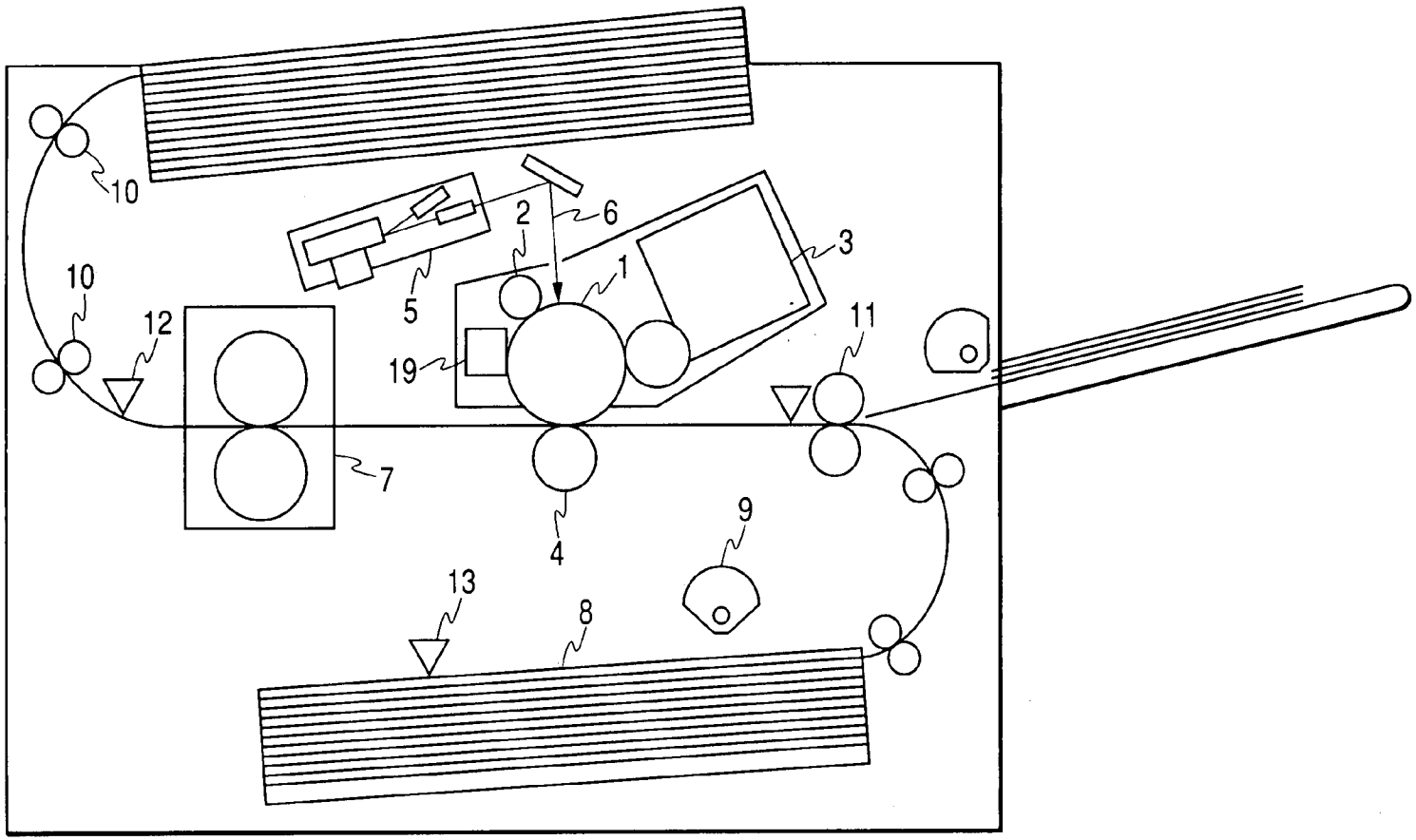
FIG. 1 is a drawing showing a mechanical configuration of an electrophotographic printer according to the first embodiment of the present invention.

FIG. 1 is a drawing showing a mechanical configuration of an electrophotographic printer according to the first embodiment of the present invention.

Numeral 1 designates a photosensitive drum for forming an electrostatic latent image, 2 a charging roller for uniformly charging the photosensitive drum 1, 5 an optical unit for scanning the area on the photosensitive drum 1 with a laser beam, 6 the laser beam emitted from the optical unit 5, 3 a developing device for developing, with toner, the electrostatic latent image formed on the photosensitive drum 1 with the laser beam, 4 a transferring roller charging device for transferring a toner image on the photosensitive drum 1 onto a predetermined sheet, 7 a fixing device for fusing the toner on the sheet to fix the toner image on the sheet, 8 a standard cassette for carrying sheets for print, 9 a standard cassette sheet feed roller for picking up a sheet from the standard cassette, 10 discharging rollers for discharging a sheet out of the apparatus, 11 a registration sensor for effecting registration of the leading end for printing of a sheet having been conveyed thereto, 12 a sheet discharge sensor for checking whether a sheet has normally been discharged from the fixing device, and 13 a sensor for detecting presence/absence of a sheet in the standard cassette.

These functional components operate in accordance with instructions from the printer controller described hereinafter. The printer controller performs control to operate the foregoing functional components to implement print processing, based on instructions from an unrepresented image controller.

Numeral 19 represents a non-volatile memory mounted in the cartridge, which stores information, e.g., concerning the photosensitive drum in the cartridge and the volume of toner in the developing device. Data, e.g., about consumption of toner, is written from the engine control portion into the memory according to the print operation of the engine or the like. In the engine control portion there exists a memory access means 302 described hereinafter and access is made through the memory access means 302 to the non-volatile memory 19 at a predetermined timing, or in accordance with a read request or a write request from the printer controller.

Figure 2:
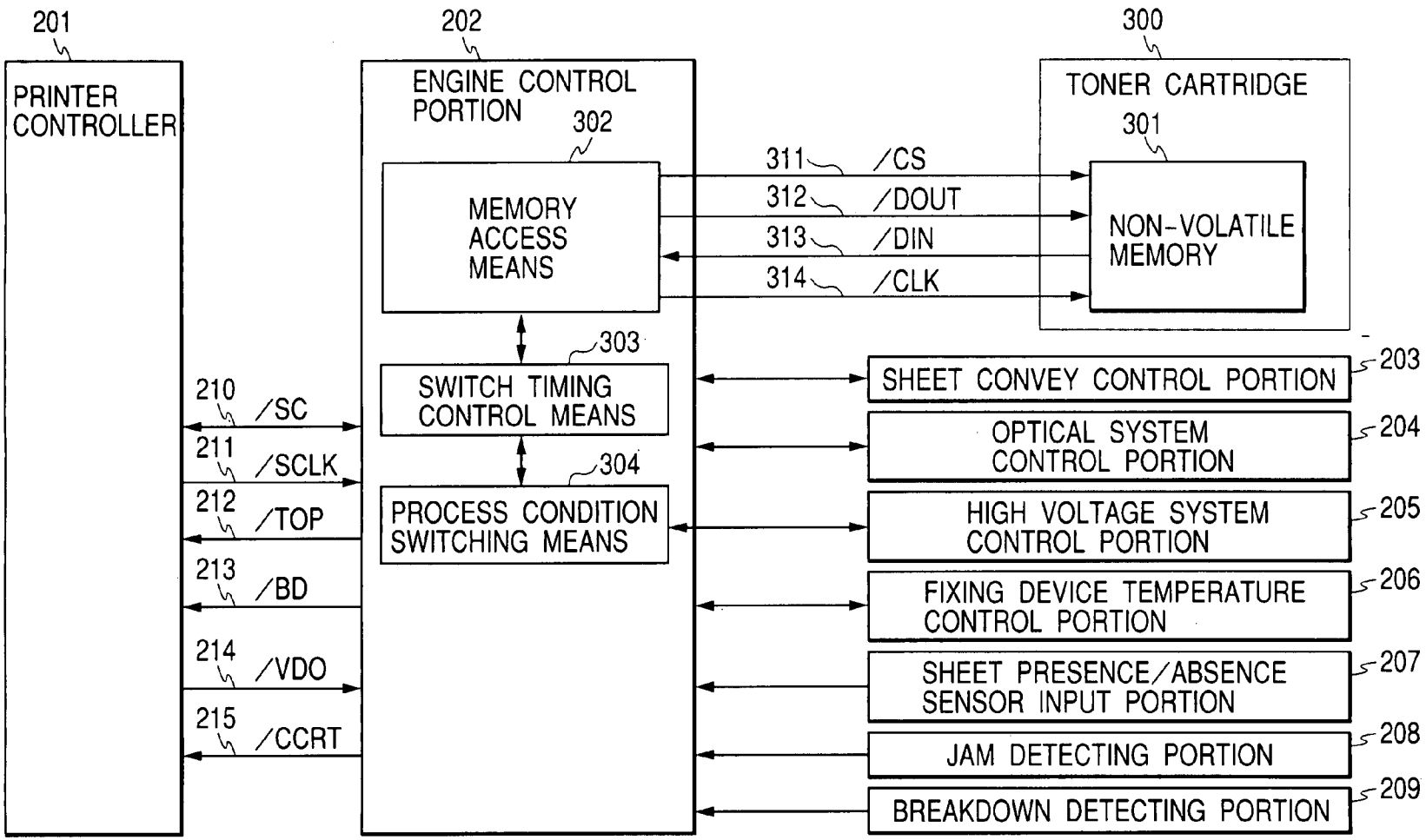
FIG. 2 is a block diagram showing the printer control portion according to the first embodiment.

FIG. 2 is a block diagram showing the printer control portion.

Numeral 201 designates the printer controller, which performs the communication with the host computer, which receives image data and expands the received image data into information for the printer to be able to print, and which executes exchange and serial communication of signals with the printer engine control portion described hereinafter. Numeral 202 denotes the engine control portion, which executes control of each unit in the printer engine through the exchange and serial communication of signals with the printer controller.

Numeral 203 represents the sheet convey control portion which sequentially performs the processes of feeding, conveyance, and discharging of a sheet, based on an instruction from the engine control portion; 204 the optical system control portion which performs driving/stopping of the scanner motor, control of emission of laser, etc., based on an instruction from the engine control portion; and 205 the high voltage control portion which executes control of respective high voltages of charging, developing, and transferring, based on an instruction from the engine control portion, the high voltage control portion carrying out control to switch process conditions in accordance with an instruction from a process condition switching means in the engine control portion, which will be described hereinafter. In the present embodiment, the apparatus is adapted to perform control to lower the electric current value with an increase in an operation quantity, based on the operation quantity of the drum (total drum rotation time).

Numeral 206 indicates the fixing temperature control portion which carries out control of the temperature of the fixing device, based on an instruction from the engine control portion; 207 the sheet presence/absence sensor input portion which detects presence/absence of a sheet in the cassette, presence/absence of a sheet in the conveyance path, etc., to transmit the detection result to the engine control portion; 208 the jam detecting portion which detects an abnormality in sheet conveyance; 209 the breakdown detecting portion which detects an abnormality of each function in the print process, such as an abnormality of the motor for sheet conveyance, an abnormality of the fixing device, and so on; 300 the toner cartridge which incorporates the photosensitive drum and the charging and developing functions, which is detachably attachable to the printer engine, which carries the non-volatile memory 301 inside, and which has the function of transmitting and receiving data to and from the engine control portion; and 302 the memory access means in the engine control portion, which performs reading/writing of data from or in the non-volatile memory 301 in the toner cartridge.

Signals between the printer controller and the engine control portion will be described.

Numeral 210 represents a serial data signal in the serial communication between the print controller and the engine control portion, and this signal handles a command outputted from the printer controller and a signal of status outputted from the engine control portion in two ways. Numeral 211 indicates a synchronous clock in the serial communication, which is outputted from the printer controller to the engine control portion.

Numeral 212 stands for/TOP signal which is a vertical synchronizing signal to designate a start of sending of an image signal when a sheet has been conveyed up to the image write position after a start of sheet conveyance; 213 for/BD signal which is a horizontal synchronizing signal for image synchronization in the main scanning direction; 214 for an image signal; 215 for/CCRT signal which is a condition change reporting signal for reporting a condition change from the engine control portion to the printer controller upon occurrence of a condition change, e.g., either of various condition changes in the engine (for example, presence/absence of sheet, occurrence of jam, and occurrence of breakdown).

The serial communication between the engine control portion and the non-volatile memory will be described below.

Numeral 311 represents /CS signal which is a chip select signal outputted from the memory access means to the non-volatile memory; 312 represents /DOUT signal which is a serial command signal outputted from the memory access means to the non-volatile memory; 313 represents /DIN signal which is a data signal returned from the non-volatile memory to the memory access means; and 314 represents /CLK signal which is a serial synchronous clock outputted from the memory access means to the non-volatile memory.

Numeral 303 denotes a switch timing control means in the engine control portion, which monitors the state of the engine control portion and which determines switch timing of the process conditions. Numeral 304 denotes a process condition switching means which gives the high voltage control portion an instruction to change the predetermined high voltage outputs to outputs matching with the memory contents, in accordance with an instruction from the switch timing control means 303.

In the present embodiment, the switch timing control means judges whether the engine control portion is in the print operation, i.e., whether it is in control of sheet conveyance or in output for charging or developing of the electrophotographic process for printing, and determines the switch timing at the time when the both are negative; not in the sheet conveyance and not in the electrophotographic process.

With determination of the switch timing, the process condition switching means is informed of a primary charging current value based on the drum operation quantity data in the memory, and the new set value will be outputted upon next application of high voltage.

Figure 3:
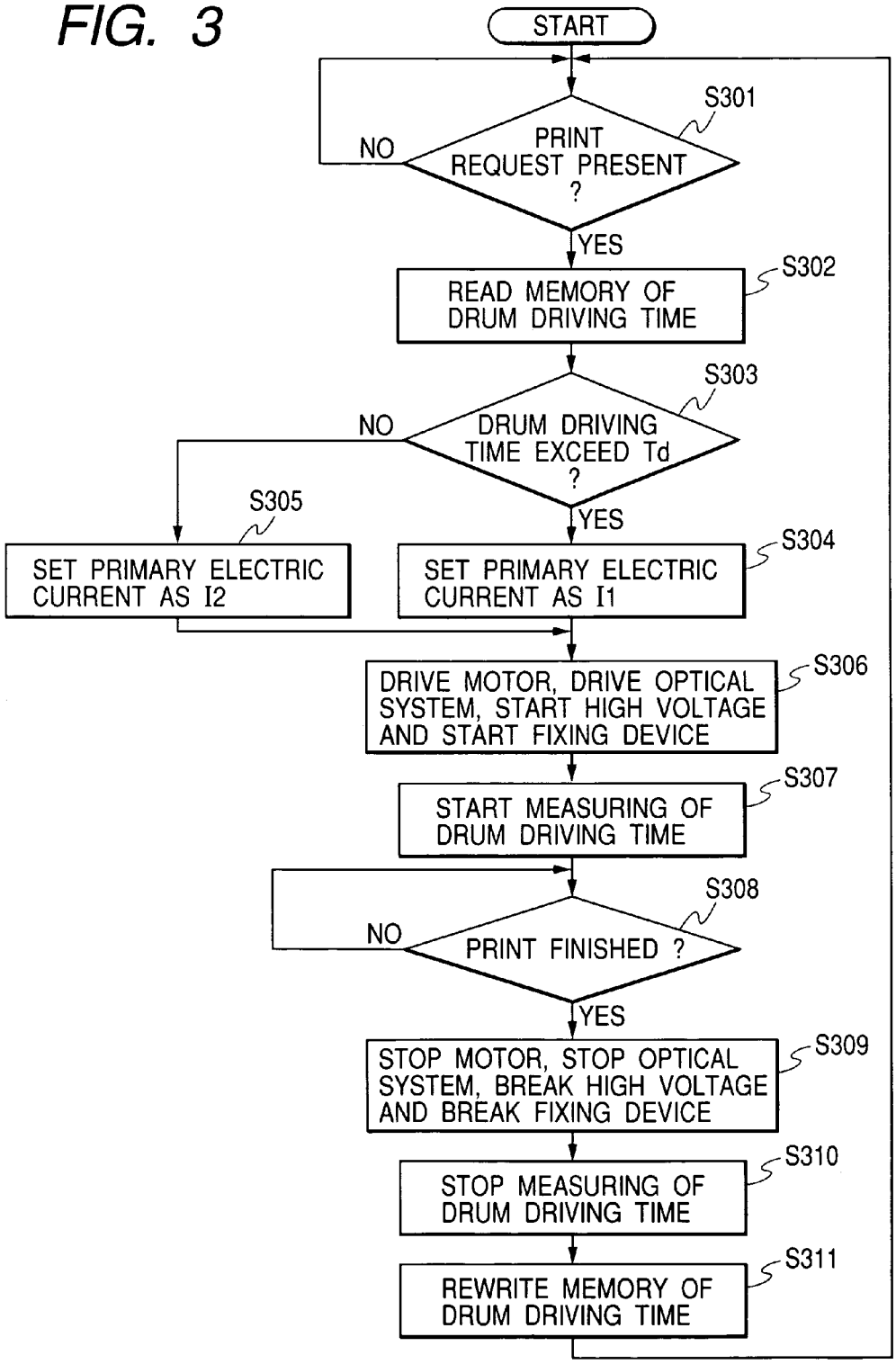
FIG. 3 is a flowchart of a sequence in the engine control portion according to the first embodiment.

FIG. 3 is the flowchart showing the above sequence of the engine control portion.

First, the engine control portion checks whether a print request from the controller is present (step S301).

When the condition for switching of primary current is met, data of the sum of drum driving time is read from the non-volatile memory in the cartridge, which stores the data corresponding to the sum of past drum driving time (step S302).

It is then determined whether the sum exceeds Td being a threshold of primary current (step S303). When the sum exceeds Td, the primary current is set to I1 (step S304). When it does not exceed Td, the primary current is set to I2 (step S305).

After that, the engine control portion starts driving the motor for printing, starts the optical system including the scanner motor and others, starts the various high voltages, and starts the temperature control of the fixing device (step S306).

The engine control portion starts measuring of the drum driving time at the same time as the start of driving of the motor (step S307).

It is then determined whether the print is finished (step S308). When it is determined that the print is finished, the engine control portion terminates the fixing temperature control, stops the motor, breaks the high voltages, stops the optical system, and terminates the driving of the drum finally (step S309).

Then the engine control portion stops the measuring of the driving time of the drum (step S310) and it adds the result of the measuring of drum driving time at that time to the sum of drum driving time in the non-volatile memory in the cartridge and again stores the result of the addition in the non-volatile memory (step S311). After that, the engine control portion goes into the first state of waiting for a print request (step S301).

According to the sequence as described above, the switching of primary current is not effected instantly, but is postponed at least to the end of print.

Figure 4:
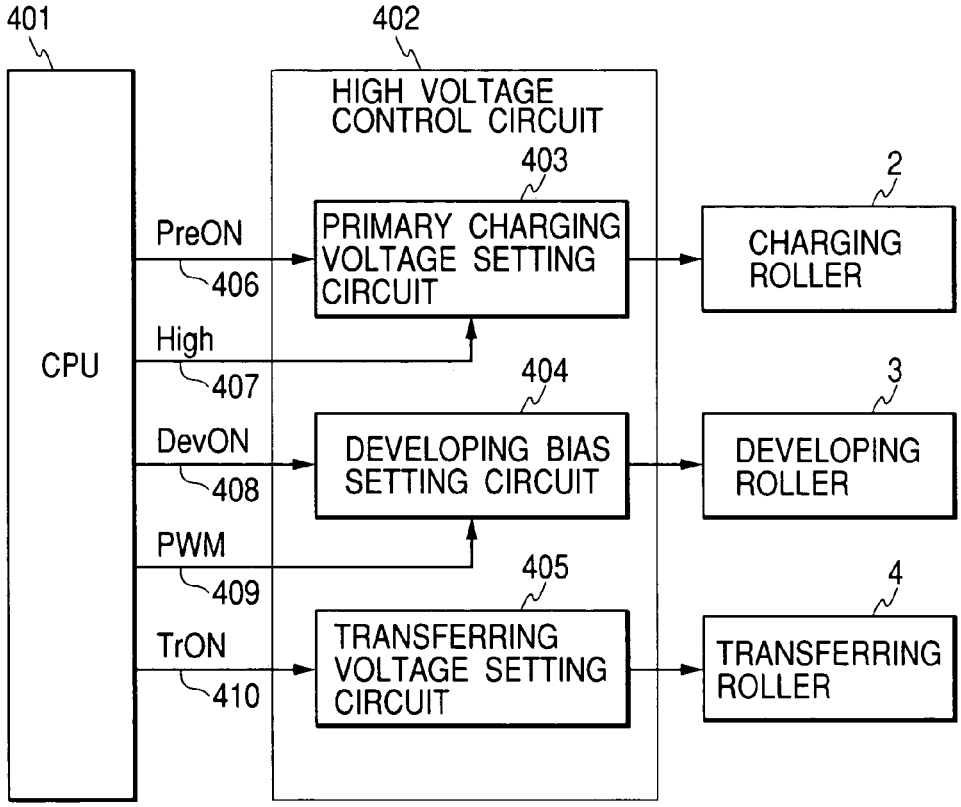
FIG. 4 is a block diagram showing a system for carrying out switching of primary current according to the first embodiment.

FIG. 4 is a block diagram showing a system for carrying out the switching of primary current.

Numeral 401 designates a CPU presiding over the center of the engine control portion, only a high voltage control part of which is extracted in the illustration herein. Numeral 402 denotes a high voltage control circuit, which controls output of the respective high voltages for primary charging, developing bias, and transferring charging and which performs the switching of output in accordance with an instruction from the CPU. Numeral 403 represents a primary charging voltage setting circuit which outputs the primary charting voltage in a value designated from the CPU, to the charging roller 2; 404 a developing bias setting circuit which outputs a developing bias in accordance with an instruction from the CPU; 405 a transferring voltage setting circuit which outputs the transferring voltage in accordance with an instruction from the CPU.

The CPU can turn the primary charging on or off by PreON signal. The CPU can also switch the primary charging current value between I1 and I2 by High signal.

Second Embodiment

The second embodiment will be described next. Since the mechanical configuration of the electrophotographic printer in the second embodiment is similar to that in FIG. 1 in the first embodiment, the description thereof is omitted herein.

Figure 5:
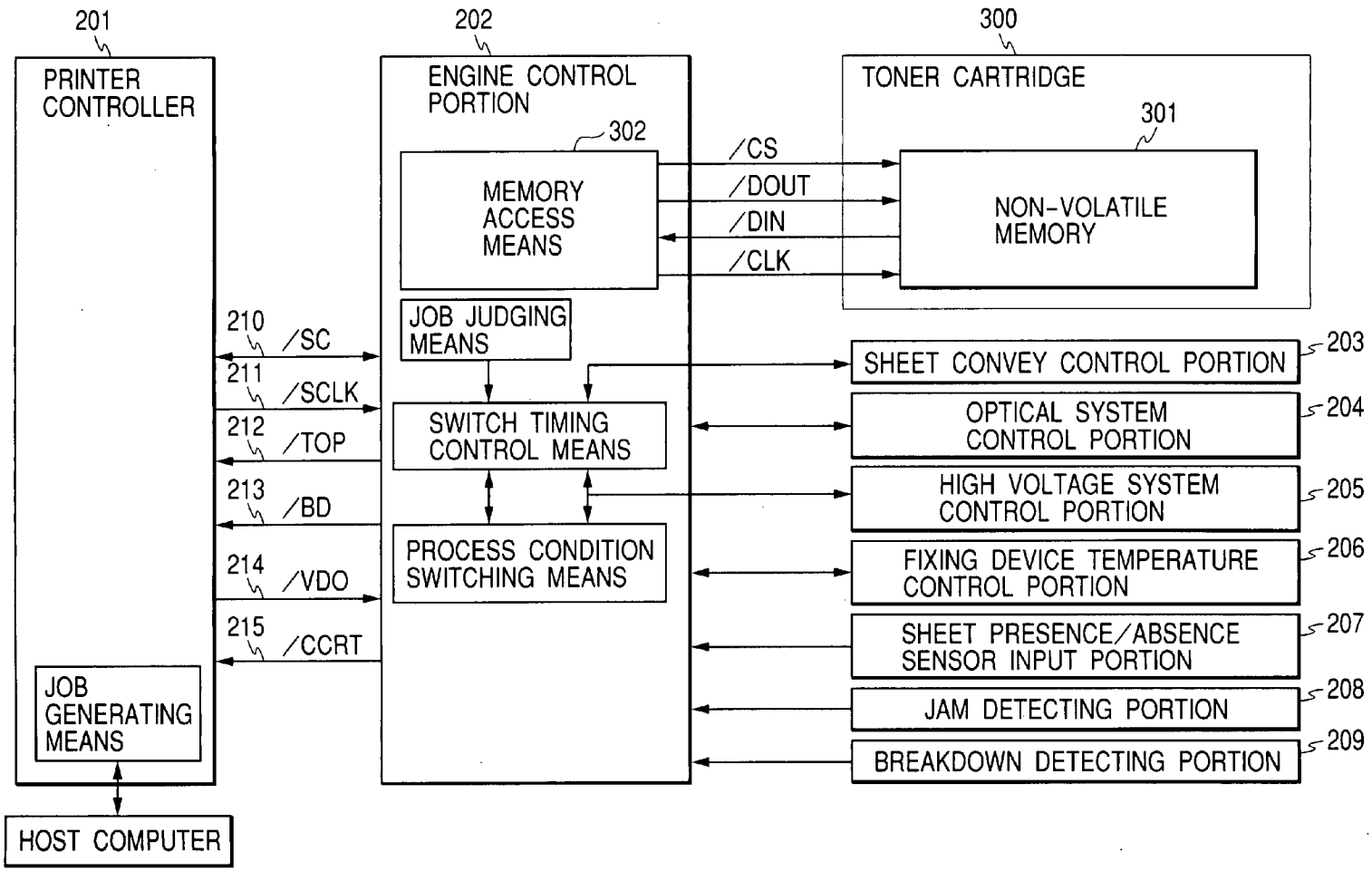
FIG. 5 is a block diagram showing the printer control portion according to the second embodiment.

FIG. 5 is a block diagram showing the printer control portion according to the second embodiment.

Numeral 201 designates the printer controller, which performs the communication with the host computer, which receives image data and expands the received image data into information for the printer to be able to print, and which executes the exchange and serial communication of signals with the printer engine control portion described hereinafter. Numeral 202 denotes the engine control portion, which executes the control of each unit in the printer engine through the exchange and serial communication of signals with the printer controller.

Numeral 203 represents the sheet convey control portion which sequentially performs the processes of feeding, conveyance, and sheet discharging, based on an instruction from the engine control portion. Numeral 204 represents the optical system control portion which performs driving/stopping of the scanner motor, control of laser emission, etc., based on an instruction from the engine control portion. Numeral 205 represents the high voltage control portion which executes control of the respective high voltages of charging, developing, and transferring, based on an instruction from the engine control portion, the high voltage control portion carrying out control to switch the process conditions in accordance with an instruction from the process condition switching means in the engine control portion, which will be described hereinafter. In the present embodiment, the apparatus is adapted to perform the control to lower the electric current value with an increase in an operation quantity, based on the operation quantity of the drum (total drum rotation time).

Numeral 206 indicates the fixing temperature control portion which carries out the control of temperature of the fixing device, based on an instruction from the engine control portion. Numeral 207 represents the sheet presence/absence sensor input portion which detects presence/absence of a sheet in the cassette, presence/absence of a sheet in the conveyance path, etc., to transmit the detection result to the engine control portion. Numeral 208 indicates the jam detecting portion which detects an abnormality in sheet conveyance. Numeral 209 indicates the breakdown detecting portion which detects an abnormality of each function in the print process, such as an abnormality of the motor for sheet conveyance, an abnormality of the fixing device, and so on. Numeral 300 indicates the toner cartridge which incorporates the photosensitive drum and the charging and developing functions, which is detachably attachable to the printer engine, which carries the non-volatile memory 301 inside, and which has the function of transmitting and receiving data to and from the engine control portion. Numeral 302 indicates the memory access means in the engine control portion, which performs reading/writing of data from or in the non-volatile memory 301 in the toner cartridge.

Signals between the printer controller and the engine control portion will be described.

Numeral 210 represents a serial data signal in the serial communication between the print controller and the engine control portion, and this signal handles a command outputted from the printer controller and a signal of status outputted from the engine control portion in two ways. Numeral 211 indicates a synchronous clock in the serial communication, which is outputted from the printer controller to the engine control portion. Numeral 212 stands for /TOP signal which is a vertical synchronizing signal to designate a start of sending of an image signal when a sheet has been conveyed up to the image write position after a start of sheet conveyance; 213 for /BD signal which is a horizontal synchronizing signal for image synchronization in the main scanning direction; 214 for an image signal; 215 for /CCRT signal which is a condition change reporting signal for reporting a condition change from the engine control portion to the printer controller upon occurrence of a condition change, e.g., either of various condition changes in the engine (for example, presence/absence of sheet, occurrence of jam, and occurrence of breakdown). The serial communication between the engine control portion and the non-volatile memory will be described below.

Numeral 311 represents /CS signal which is a chip select signal outputted from the memory access means to the non-volatile memory; 312 /DOUT signal which is a serial command signal outputted from the memory access means to the non-volatile memory; 313 /DIN signal which is a data signal returned from the non-volatile memory to the memory access means; 314 /CLK signal which is a serial synchronous clock outputted from the memory access means to the non-volatile memory.

In the first embodiment, the switch timing of primary current was determined based on the information intrinsic to the engine, i.e., based on whether a transition is made into the standby state. In the second embodiment, however, the engine control portion determines the switch timing of primary current value, based on reception of job information from the printer controller, i.e., information about a predetermined heap of print works from the user under print requests from the host computer to the printer controller.

The job information from the printer controller is transmitted through the serial communication between the foregoing printer controller and the engine control portion.

Numeral 303 denotes the switch timing control means in the engine control portion, which monitors the state of the engine control portion and which determines the switch timing of the process conditions; 304 the process condition switching means which gives the high voltage control portion an instruction to change the predetermined high voltage outputs to outputs matching with the memory contents, in accordance with an instruction from the switch timing control means 303.

In the present embodiment, the switch timing control means performs the switch work at the time when the engine has completed the print of a series of print jobs designated from the printer controller, based on the job information designated from the printer controller, to go into the standby state, and the control means then executes the print at the primary current value thus switched, from a next designated print job.

FIG. 6 shows the job information designated for the engine control portion by the print controller in the serial communication. The serial communication is of a 16-bit configuration and the highest four bits thereof indicate a job information designating command. Eleven bits below them except for the parity bit designate the number of prints in a job printed next. In the present embodiment, the figure shows such an illustration that the job information designating command is indicated when the highest four bits are 0001 B.

This command demonstrates its effect when it is outputted prior to output of a print request from the printer controller. Namely, by issuing the foregoing job designating command prior to the print request, it is recognized how many prints from the next requested print are in one job.

Figure 7:
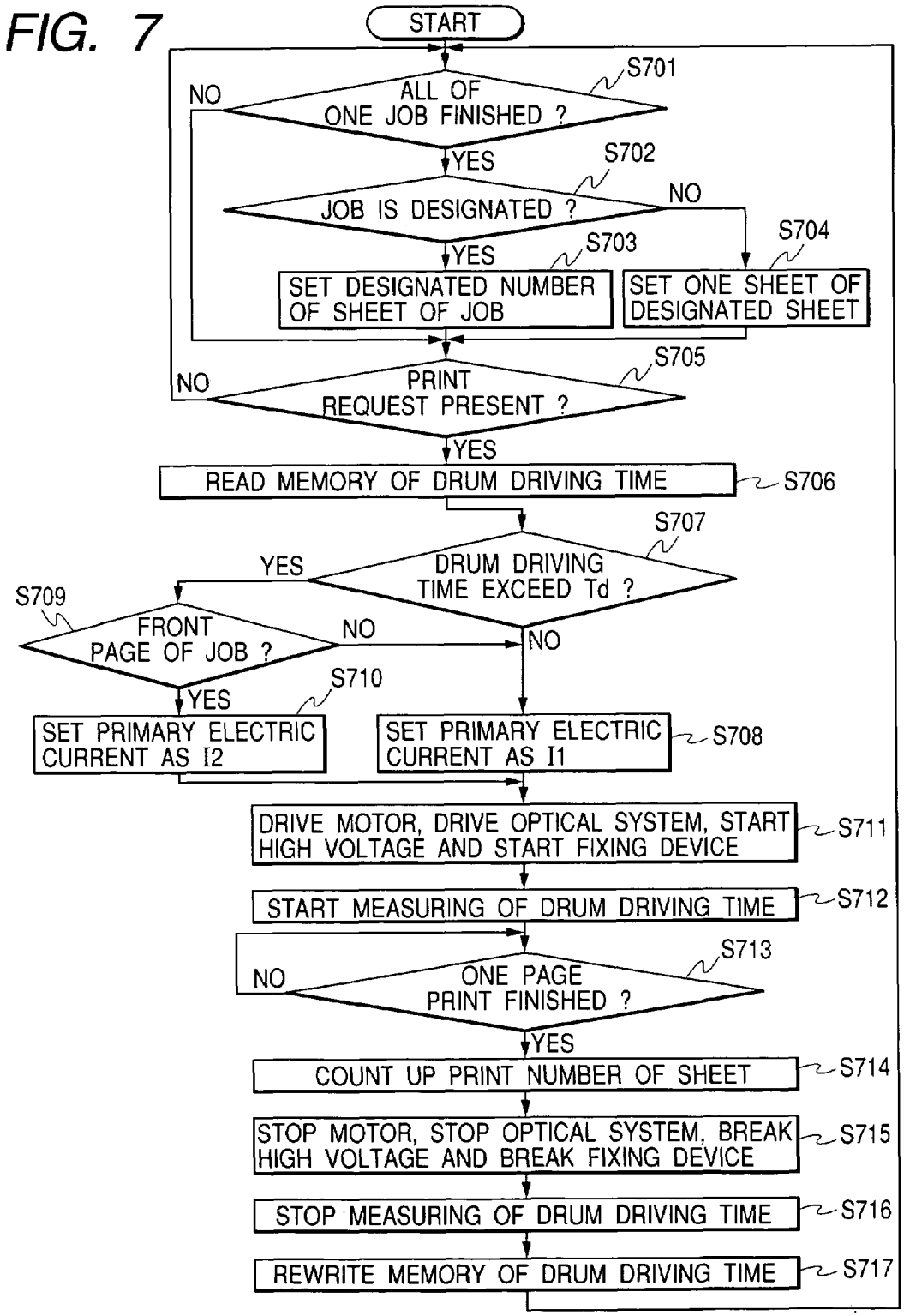
FIG. 7 is a flowchart showing the flow of control of the above engine control portion according to the second embodiment.

FIG. 7 is a flowchart showing the control of the above engine control portion.

First, the engine control portion determines whether all printing of a print job in the number designated from the printer controller is finished (step S701). When all is finished, the engine control portion starts checking whether a next job is designated (step S702). When there is a designated print job from the printer controller, the number of print is stored (step S703). When there is no designation, the engine control portion sets job designation of one print as a default value (step S704).

After that, the engine control portion checks whether a print request is present (step S705). When there is a print request, the engine control portion reads the drum driving time used as a threshold for switching of primary current from the data stored in the non-volatile memory in the cartridge (step S706). When there is no print request, the engine control portion returns to step S701. After the process at step S706, the engine control portion determines whether the drum driving time exceeds the predetermined time (step S707). When it is determined as a result that the drum driving time does not exceed Td being the predetermined threshold, the engine control portion sets the initial primary current value I1 (step S708). When the drum driving time exceeds the threshold Td, it is determined whether the printer is at the first page of the job (step S709). When it is at the first page, the primary current value is set to I2 (step S710).

After that, the engine control portion starts driving the motor for the print, starts the optical system including the scanner motor and others, starts the various high voltages, and starts the temperature control of the fixing device (step S711). Then the engine control portion executes the actual print operation and the measurement to count the drum driving time (step S712). It is then determined whether the print of one page is finished (step S713). When it is determined that the print is finished, the print number is counted up (step S714); the break processes of the high voltages, the optical system, etc. are carried out (step S715); the measuring of the drum driving time is terminated (step S716); the result of the measuring of the drum driving time at that time is further added to the sum of drum driving time in the non-volatile memory in the cartridge and the result of the addition is again stored in the non-volatile memory (step S717).

After completion of the above, the engine control unit returns to the first process (step S701).

According to the above processing, before completion of printing in the print number of the job designated from the printer controller, the engine control portion does not switch the primary current in the middle of the job before finishing the printing operation through the print number of the designated job even if the sum of drum driving time exceeds the predetermined threshold to meet the primary current switch condition. In addition, switching is not effected during the print operation, either, whereby the primary current can be switched at optimal timing.

Third Embodiment

In the first and second embodiments, the serial communication is implemented by signals through wires between the non-volatile memory and the engine control portion.

Figure 8:
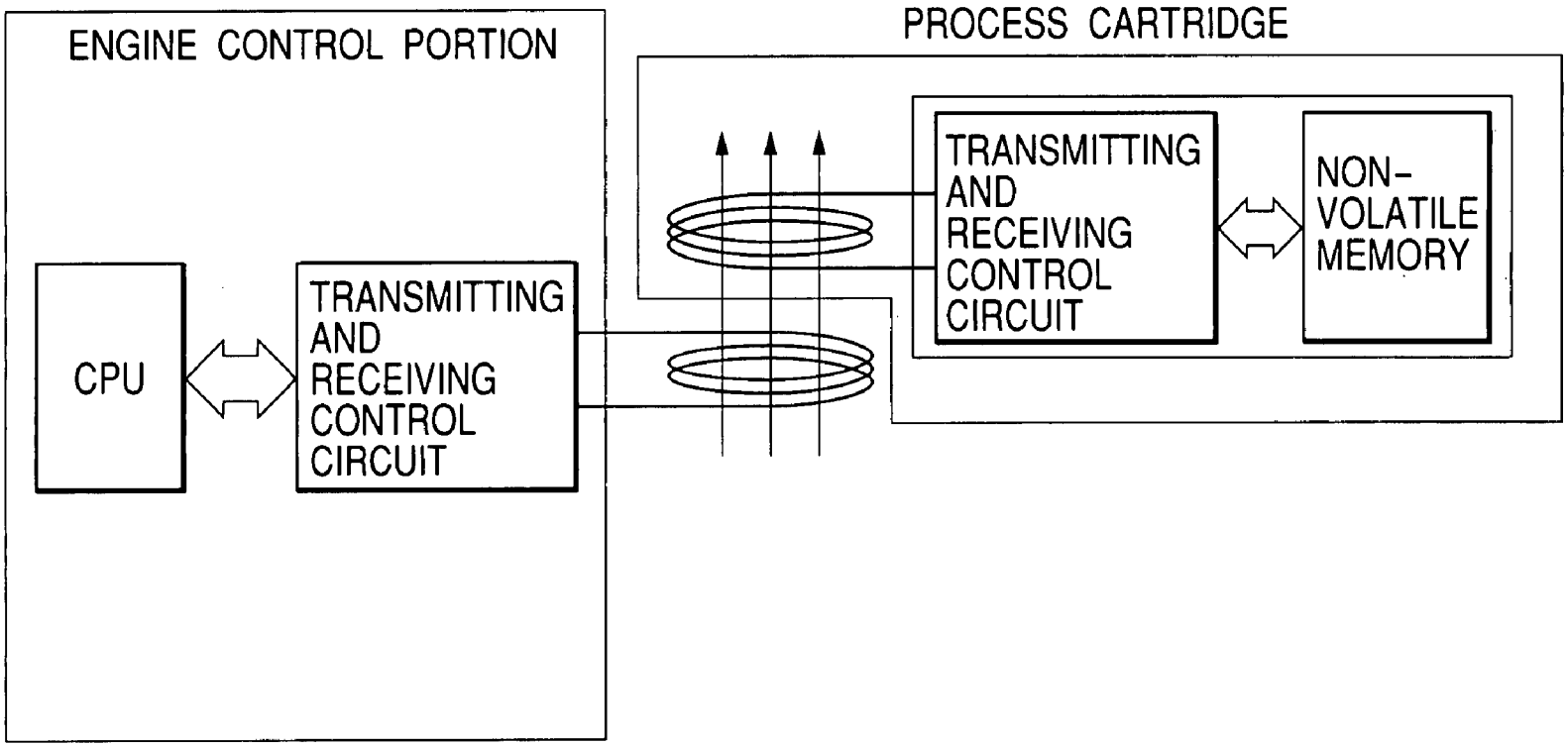
FIG. 8 is a drawing showing an example using an FeRAM or the like as a non-volatile memory according to the third embodiment of the present invention.
Figure 9:
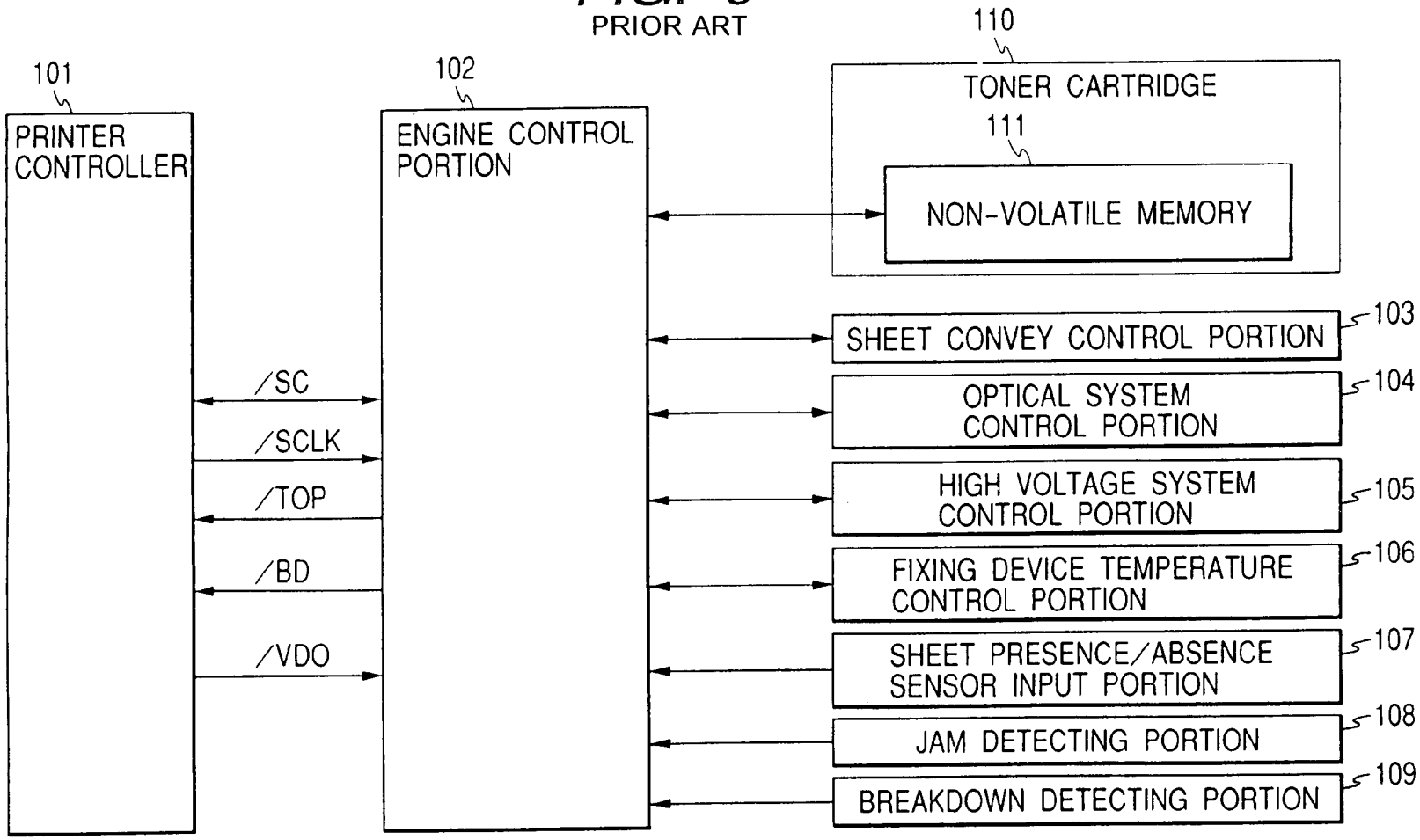
FIG. 9 PRIOR ART
FIG. 9 is a block diagram showing the conventional printer control portion.

However, it is also feasible to employ such a configuration that the non-volatile memory such as an FeRAM or the like is mounted in the cartridge and the exchange of data is implemented with the memory by use of electromagnetic coupling through coils, as shown in FIG. 8, and this configuration according to the present invention can also achieve the same effects as in the case of the wire communication.

Other Embodiments

The present invention may be applied to systems comprised of a plurality of devices (e.g., a host computer, an interface device, a reader, a printer, etc.) and also to an apparatus consisting of one device (e.g., a copier, a facsimile device, etc.).

It is also needless to mention that the object of the present invention can also be accomplished by supplying a storage medium (or recording medium) storing the program code of software for realizing the functions of the aforementioned embodiments, to a system or apparatus and making a computer (or CPU or MPU) of the system or apparatus read and execute the program code stored in the storage medium. In this case, the program code itself read out of the storage medium realizes the functions of the foregoing embodiments, so that the storage medium storing the program code constitutes the present invention.

It is also needless to mention that, in addition to the configuration wherein the computer executes the program code thus read to implement the functions of the foregoing embodiments, the invention also embraces such a configuration that, based on instructions of the program code, an operating system (OS) operating on the computer executes part or the whole of the actual processing and the processing implements the functions of the foregoing embodiments.

Further, it is also a matter of course that the present invention also embraces such a configuration that the program code read out of the storage medium is written into a memory in a function extension card inserted into a computer or in a function extension unit connected to a computer, then a CPU in the function extension card or in the function extension unit executes part or the whole of the actual processing, based on the instructions of the program code, and the processing implements the functions of the foregoing embodiments.

When the present invention is applied to the above storage medium, the program code corresponding to the flowcharts described previously (as shown in FIG. 3 and/or FIG. 7) is stored in the storage medium.

According to the present invention, as described above, the switch instruction to switch the electrophotographic process condition is given when the engine control portion is not in execution of the electrophotographic process, whereby switching of the process condition is not effected for the switching process of the primary current value for extending the lifetime of the drum, which makes it feasible to achieve the effects of maintaining the uniformity of image quality in printing of identical images and drastically improving the performance of the printer.

The present invention was described above with some preferred embodiments thereof, but it is noted that the present invention is by no means intended to be limited to these embodiments and it is apparent that the present invention can involve various modifications and applications in the scope of claims.

What is claimed is:

1. An image forming apparatus to which a process cartridge is detachably attachable, the process cartridge including an element relating to image formation, said image forming apparatus comprising:

an image forming unit adapted to drive the process cartridge to form an image; and a switching unit adapted to switch an image forming condition of said image forming unit on the basis of an accumulation of a drive time of the process cartridge driven by said image forming unit, wherein when the accumulation of the drive time reaches a predetermined value, said switching unit switches the image forming condition at a timing which is not during performing a job for forming a plurality of images.

2. An image forming apparatus according to claim 1, wherein the process cartridge is provided with a non-volatile memory medium for storing the accumulation value of the drive time of the process cartridge driven by said image forming unit.

3. An image forming apparatus according to claim 2, wherein the non-volatile memory medium is a ferromagnetic memory or a ferroelectric memory.

4. An image forming apparatus according to claim 1, wherein said switching unit switches the image forming condition at a timing when said image forming unit does not perform an electrophotographic process.

5. An image forming apparatus according to claim 1, wherein said switching unit switches the image forming condition at a timing when a sheet is not conveyed.

6. An image forming apparatus according to claim 1, wherein said switching unit switches a primary charging current.

7. An image forming apparatus according to claim 1, wherein said drive time is a drive time of a photosensitive drum comprised in the process cartridge.

8. A control method for an image forming apparatus to which a process cartridge is detachably attachable, the process cartridge including an element relating to image formation, said control method comprising:

a step of counting a drive time of the process cartridge driven in the image forming apparatus;

a step of determining whether an accumulation of the drive time counted in said counting step reaches a predetermined value; and a step of switching an image forming condition of the image forming apparatus at a timing which is not during performing a job for forming a plurality of images, when it is determined in said determining step that the accumulation of the drive time reaches the predetermined value.

* * * * *